US007806199B2

(12) United States Patent
Pohl et al.

(10) Patent No.: US 7,806,199 B2
(45) Date of Patent: Oct. 5, 2010

(54) SPINDLE LOCK FOR A HAND-HELD COMBINATION DRILL AND CHISEL HAMMER

(75) Inventors: Stefan Pohl, Waiblingen (DE); Jürgen Hopp, Winnenden (DE)

(73) Assignee: AEG Electric Tools GmbH, Winnenden (DE)

( * ) Notice: Subject to any disclaimer, the term of this patent is extended or adjusted under 35 U.S.C. 154(b) by 208 days.

(21) Appl. No.: 12/056,303

(22) Filed: Mar. 27, 2008

(65) Prior Publication Data

US 2008/0238001 A1 Oct. 2, 2008

(30) Foreign Application Priority Data

Mar. 28, 2007 (DE) ..... 10 2007 014 800

(51) Int. Cl.
*E02D 7/02* (2006.01)

(52) U.S. Cl. ..... 173/48; 173/216; 173/217; 173/171

(58) Field of Classification Search ..... 173/48, 173/216, 217, 171; 408/124, 170; 144/136.95, 144/154.5; 81/57.22
See application file for complete search history.

(56) References Cited

U.S. PATENT DOCUMENTS 4,400,995 A * 8/1983 Palm ..... 74/527
5,191,968 A * 3/1993 McCurry ..... 200/43.11
5,346,342 A * 9/1994 Winchester ..... 409/134
6,035,945 A 3/2000 Ichijyou et al.
6,109,364 A * 8/2000 Demuth et al. ..... 173/48
6,192,996 B1 2/2001 Sakaguchi et al.
6,224,304 B1 * 5/2001 Smith et al. ..... 409/182
6,460,627 B1 * 10/2002 Below et al. ..... 173/48
6,488,451 B1 * 12/2002 Hartman ..... 408/124
6,648,567 B2 * 11/2003 Berry et al. ..... 409/182
6,666,284 B2 12/2003 Stirm
6,789,630 B2 * 9/2004 Quirijnen et al. ..... 173/48
6,886,643 B2 * 5/2005 Riley et al. ..... 173/29
6,913,090 B2 * 7/2005 Droste et al. ..... 173/109
6,918,450 B2 * 7/2005 Lebisch et al. ..... 173/104
7,174,969 B2 * 2/2007 Droste ..... 173/48
7,287,602 B2 * 10/2007 Zeiter et al. ..... 173/213
7,395,872 B2 7/2008 Duesselberg et al.
7,578,358 B2 8/2009 Hess et al.
2005/0155227 A1 * 7/2005 Botefuhr et al. ..... 30/276
2008/0169111 A1 7/2008 Duesselberg et al.

FOREIGN PATENT DOCUMENTS

EP 735282 A1 * 10/1996
WO 2006/029916 3/2006
WO 2007/060043 5/2007

* cited by examiner

*Primary Examiner*—Rinaldi I. Rada
*Assistant Examiner*—Michelle Lopez
(74) *Attorney, Agent, or Firm*—Gudrun E. Huckett

(57) ABSTRACT

A spindle lock of a hand-held combination drill and chisel hammer has a gearbox housing and a countershaft rotatably supported in the gearbox housing about an axis of rotation. A locking plate is provided for selectively releasing and locking a rotational movement of the countershaft. Guide elements are disposed in the gearbox housing, wherein the locking plate is displaceably guided on the guide elements in the gearbox housing in a direction parallel to the axis of rotation of the countershaft. The guide elements have a guide rail arrangement wherein a part of the guide rail arrangement is provided on the gearbox housing and is integral with the gearbox housing.

7 Claims, 4 Drawing Sheets

SPINDLE LOCK FOR A HAND-HELD COMBINATION DRILL AND CHISEL HAMMER

BACKGROUND OF THE INVENTION

The invention relates to a spindle lock of a hand-held combination drill and chisel hammer comprising a gearbox, a countershaft rotatably supported in the gearbox about an axis of rotation, and a locking plate that is guided in guide means within the gearbox parallel to the axis of rotation, wherein the movable locking plate is provided for selectively locking and releasing rotational movement of the countershaft.

A similar spindle lock is disclosed in DE 10 2004 052 329 A1 in which however the tool spindle and not the countershaft can be locked directly by means of a locking plate.

Hand-held combination drill and chisel hammers are operated in different working modes depending on the application. As selected by the operator, the drive motor of the hammer device can either provide purely a rotational movement of the tool spindle for drilling operation, can exclusively drive the hammer action without rotational movement of the tool spindle for providing purely a chiseling operation, or can provide a combined rotary and chisel drive action. For generating purely a chiseling operation, it is necessary to lock the tool spindle in the rotational direction. Such a locking action is usually provided by locking, as needed, the countershaft that is provided for driving in rotation the tool spindle.

In such a prior art spindle lock, a locking plate is provided that is guided slidably in the gearbox parallel to the axis of rotation of the countershaft. The locking plate has a section that surrounds the countershaft and this section is provided with teeth that are pushed upon axial displacement into gaps between teeth of a pinion on the countershaft. The locking plate that is fixedly connected to the gearbox housing prevents in this position a rotational movement of the pinion that is rotatably supported on the countershaft and therefore also a rotational movement of the tool spindle that is driven by it.

In prior art devices, guide pins are inserted into the gearbox housing for providing the axially displaceable guiding action of the locking plate; the locking plate is slidable on the pins by means of suitable guide openings. A precise assembly of the guide pins taking into account the required strength is difficult and complex. After mounting of the guide pins has been completed, the locking plate is pushed against a pretension of a spring onto the guide pins. This mounting step is also complex and costly because the guide plate must be secured in position against the pretension force of the spring until additional assemblies that are subsequently mounted take over this securing or fixation function.

SUMMARY OF THE INVENTION

It is an object of the present invention to develop a spindle lock of the aforementioned kind in such a way that the manufacturing and assembly expenditure is reduced while at the same time the functional safety is improved.

In accordance with the present invention, this is achieved in that the guide means of the locking plate comprise at least one guide rail arrangement wherein a part of the guide rail arrangement is provided on the gearbox housing and is an integral (monolithic) part of the gearbox housing.

The integral (monolithic) formation of the guide rail arrangement part on the gearbox housing eliminates the need for a separate attachment of a guide pin. The manufacturing and assembly expenditure is reduced and at the same time the positional precision is improved. The integration of the guide rail arrangement into the gearbox housing increases the load-bearing capacity. The extension of the guide rail arrangement parallel to the displacement direction avoids any canting of the locking plate and improves its guiding precision. As a whole, the operational safety of the spindle lock is improved.

In a preferred embodiment, the guide rail arrangement comprises at least one and preferably two guide slots extending parallel to the axis of rotation in which guide slots a gliding surface is slidably guided, respectively. For a minimal surface pressure and thus minimal component load a high guiding precision and safety with regard to canting safety are provided. The gliding surfaces can be threaded during assembly with minimal expenditure into the assigned guide slots so that assembly expenditure is reduced. When providing several guide slots, the guide slots are advantageously arranged angularly to one another and in particular at a right angle relative to one another. In this way, a fixation of the locking plate in all spatial degrees of freedom with the exception of the displacement direction is possible. Already upon threading of the locking plate into the guide rail arrangement, a suitable positional orientation is provided; this further reduces the assembly expenditure. In the completed mounted state the guiding precision is further improved.

It can be expedient to provide one or several guide slots in the locking plate while suitable projections of the gearbox housing engage as gliding surfaces these guide slots. Preferably, the reverse embodiment is selected in which the guide slots are formed in the gearbox housing and the correlated gliding surface is formed by the locking plate. The geometrically complex guide slots can be formed without problems in an injection mold or a die-casting mold of the gearbox housing. In regard to the locking plate, it is sufficient to provide the required gliding surfaces by means of simple reshaping measures. Accordingly, the manufacturing expenditure is thus reduced.

In a preferred embodiment, a normal to the gliding surface extends parallel to the direction of width of the associated guide slot. Under operating load, the gliding surface is thus loaded only perpendicularly to the surface while ribs or other suitable shapes of the gearbox housing in which the respective guide slot is formed, respectively, are loaded only in their plane while transverse forces are avoided. The arrangement can therefore be of a thin-wall construction and lightweight.

In an advantageous embodiment, the guide means comprise a guide pin configured as an integral part of the gearbox housing which guide pin engages a guide opening of the locking plate. By means of the integral configuration of the guide pin and the gearbox housing, a separate mounting step for the guide pin as an individual part is not required. The guide pin contributes to a spacial positional alignment of the locking plate and thus further improves the guiding action for the locking plate provided by the guide rail arrangement. The pin shape enables moreover a double function according to which the guide pin secures and positionally fixes a spring that is embodied in particular as a pressure coil spring. This spring is provided for an automatic axial displacement of the locking plate.

In the demounted state of the countershaft, it is preferred that exclusively guide means that are formed integrally on the gearbox housing are provided for the locking plate. In this connection, a possible guiding function of the countershaft is irrelevant. When mounting the spindle lock, first the spring and the locking plate are mounted without the countershaft providing any assistance. The presence of guide means that are exclusively integrally formed on the gearbox housing avoids as a whole the prior art requirement of manufacturing and mounting separate guiding and attachment means for the locking plate.

In an expedient embodiment a locking edge that is formed integrally on the gearbox housing is provided for securing the locking plate in a direction opposite to the assembly direction. In particular, the locking edge is part of an elastically springy spring tongue formed on the gearbox housing. However, a reverse configuration is possible also in which such a spring tongue is provided on the locking plate and the spring tongue engages during assembly a locking edge of the gearbox housing. Without additional manufacturing expenditure, the assembly is further simplified. The locking plate is pushed in the assembly direction against the pretension of the spring on or into the guide means and then locked on the locking edge. While the spring pretension is maintained, the locking plate remains fixed in position until this fixation function is taken over by the subsequently mounted component assemblies. In operation of the combined drill and chisel hammer the locking edge has no function. It can therefore be designed in a simple way to withstand only minimal loads.

DESCRIPTION OF THE PREFERRED EMBODIMENTS

Figure 1:
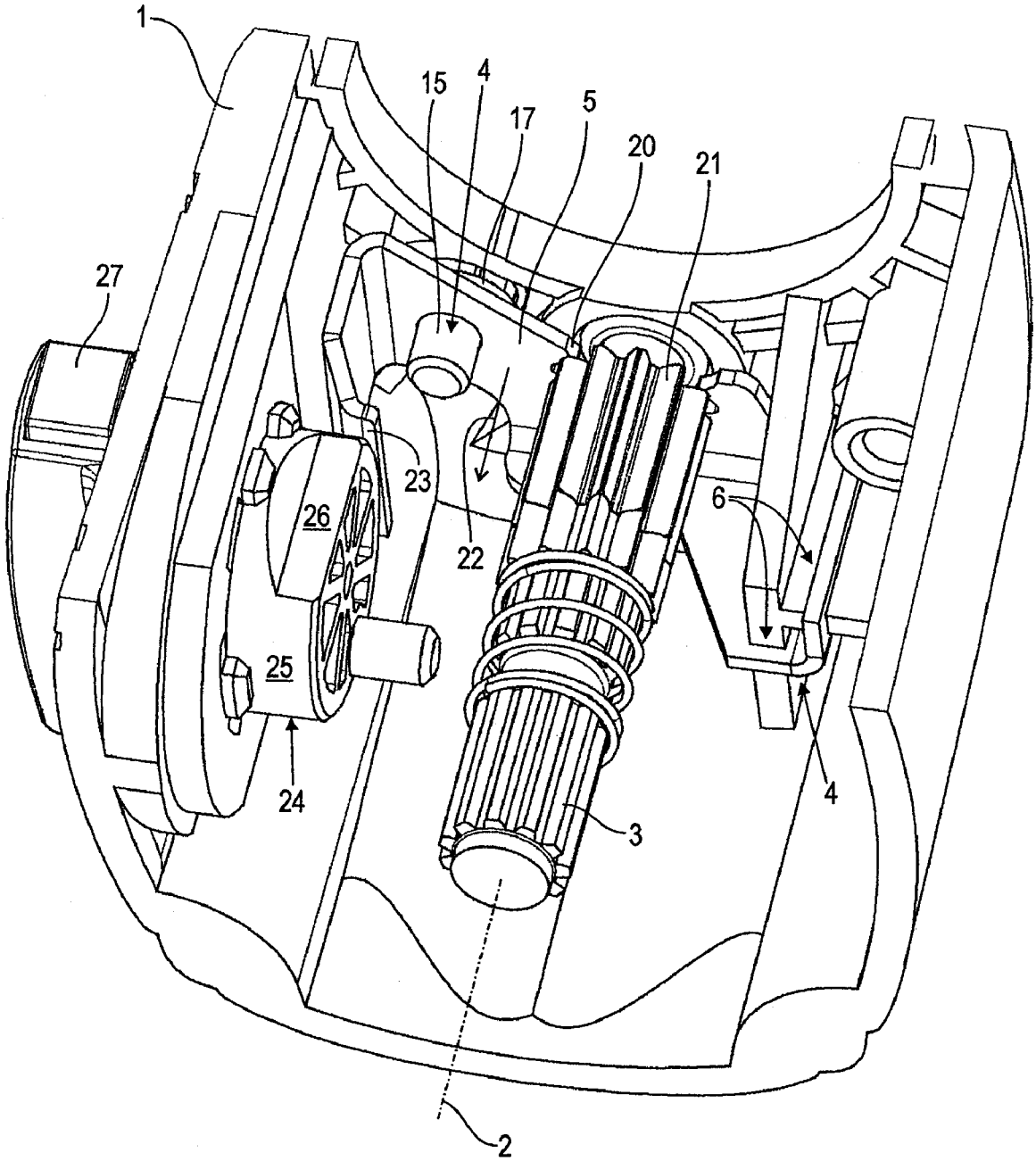
FIG. 1 is a sectioned perspective illustration of a gearbox housing with released spindle lock for a countershaft wherein a locking plate of the spindle lock is guided so as to be axially slidable in a guide rail arrangement formed integrally on the gearbox housing.

FIG. 1 shows in a perspective partially sectioned illustration a gearbox housing 1 of a hand-held combination drill and chisel hammer with a spindle lock according to the present invention. The spindle lock comprises the gearbox housing 1, a countershaft 3 that is rotatably supported in the gearbox housing 1 about axis of rotation 2, and a locking plate 5 that is displaceably guided parallel to the axis of rotation 2 in guide means 4 in the gearbox housing 1. On the countershaft 3 a pinion with a circumferential toothing 21 is rotatably supported, wherein the toothing 21 is provided for rotatingly driving the tool spindle (not illustrated) in drill operation as well as combined drill and chisel operation. The locking plate 5 has a cutout with radially inwardly projecting teeth 20; the cutout partially surrounds the countershaft 3 in the illustrated position of the locking plate 5 at the end face of the toothing 21. The teeth 20 are not in engagement with the toothing 21 so that a free rotational movement of the pinion with toothing 21 supported on the countershaft 3 and therefore of the tool spindle (not illustrated) is possible.

A spring 17 is provided that acts on the locking plate 5; in the illustrated embodiment the spring is a pressure spring. The pretensioned spring 17 generates a pressure force acting on the locking plate 5 in accordance with arrow 22 parallel to the axis of rotation 2 in the direction toward the toothing 21. In this way, as needed, an automatic engagement of the teeth 20 of the locking plate 5 in intermediate spaces or gaps of the toothing 21 of the pinion supported on the countershaft 3 can be realized.

In a side wall of the gearbox housing 1 an assembly comprised of a turn knob 27 and an actuating cylinder 24 is rotatably supported; the axis of rotation of this assembly is perpendicular to the axis of rotation 2 of the countershaft 3. The actuating cylinder 24 has a cylindrical circumferential wall 25 in which a flattened portion 26 is provided that is radially inwardly recessed relative to the circumferential wall 25. The turn knob 27 is provided to allow the operator to freely select either release or locking of the rotational movement of the pinion supported on the countershaft 3. In the illustrated rotary position of the assembly of turn knob 27 and actuating cylinder 24 an angled pressure surface 23 of the locking plate 5 rests against the cylindrical circumferential wall 25. In this way, the locking plate 5 has been moved axially along its guide means 4 against the pretension of the spring 17 that is indicated by arrow 22 to such an extent that its teeth 20 do not engage the toothing 21 of the pinion supported on the countershaft 3.

The guide means 4 for the locking plate 5 comprise the guide rail arrangement 6 as well as, relative to the axis of rotation 2, diametrically oppositely positioned a guide pin 15 whose details will be explained in more detail in connection with FIGS. 3 and 4. The configuration of the guide means 4 is selected such that the locking plate 5 can be moved only parallel to the axis of rotation 2 but in all other spacial degrees of freedom is secured relative to the gearbox housing 1. In particular, the locking plate 5 is connected fixedly to the gearbox housing 1 relative to the axis of rotation 2, i.e., cannot rotate. This serves for locking the pinion with toothing 21 supported on the countershaft 3 as needed, as illustrated in FIG. 2.

Figure 2:
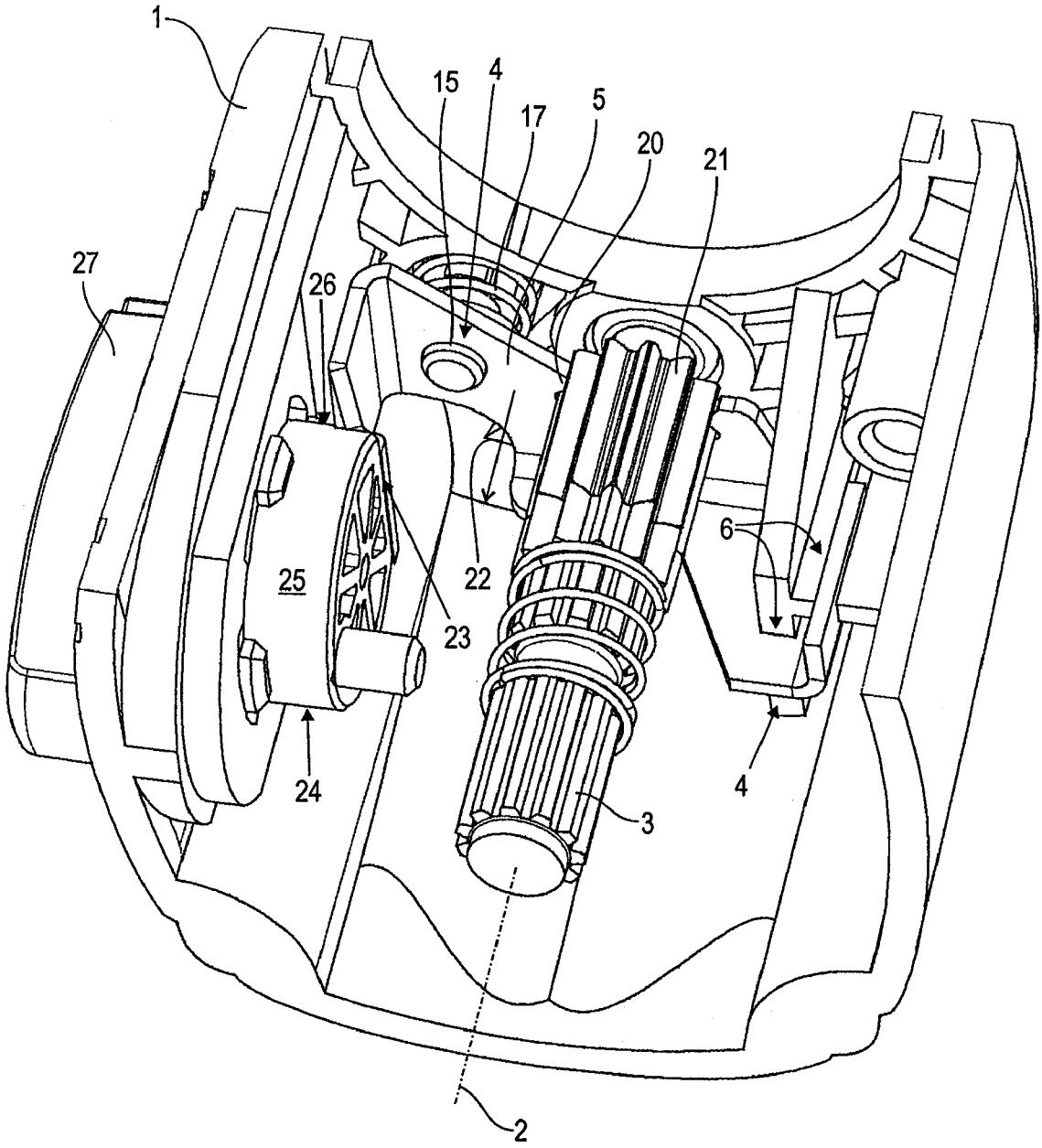
FIG. 2 shows the arrangement of FIG. 1 where the locking plate has been axially moved so as to lock the countershaft.

FIG. 2 shows the arrangement according to FIG. 1 with the turn knob 27 rotated relative to FIG. 1 by 90 degrees and with axially displaced locking plate 5; same features have same reference numerals. In the illustrated rotary position of the turn knob 27, the flattened portion 26 of the actuating cylinder 24 faces the locking plate 5. Since the flattened portion 26 relative to the circumferential wall 25 is radially recessed, the spring 17 moves the locking plate 5 on its guide means 4 in the direction of arrow 22 until the pressure surface 23 rests against the flattened portion 26. However, the spring 17 effects this axial displacement of the locking plate 5 only when a suitable rotary position of the countershaft 3 enables axial insertion of the teeth 20 of the locking plate 5 into the immediate spaces of the toothing 21. In this way, a synchronization function of the shifting process is realized. The illustration of FIG. 2 shows that this shifting process has taken place: the teeth 20 of the locking plate 5 engage the intermediate spaces of the toothing 21 of the pinion supported on the countershaft 3. The fixed guiding action of the locking plate 5 in the gearbox housing 1 prevents a rotational movement of the pinion with toothing 21 supported on the countershaft 3 so that the tool spindle (not illustrated) that is driven by the countershaft is secured in a certain rotary position for performing exclusively the chiseling operation.

Release of the rotational movement of the pinion with toothing 21 supported on the countershaft 3 is realized by returning the turn knob 27 into the rotary position according to FIG. 1. Accordingly, the cylindrical circumferential wall 25 of the actuating cylinder 24 forces the locking plate 5 against the pretension of the spring 17 in the direction of arrow 22 until the teeth 20 no longer engage the toothing 21. The rotational movement of the pinion with toothing 21 seated on the countershaft 3 is released again. The drive motor, not illustrated, can now drive in rotation the tool spindle (not illustrated) by means of the countershaft 3.

Figure 3:
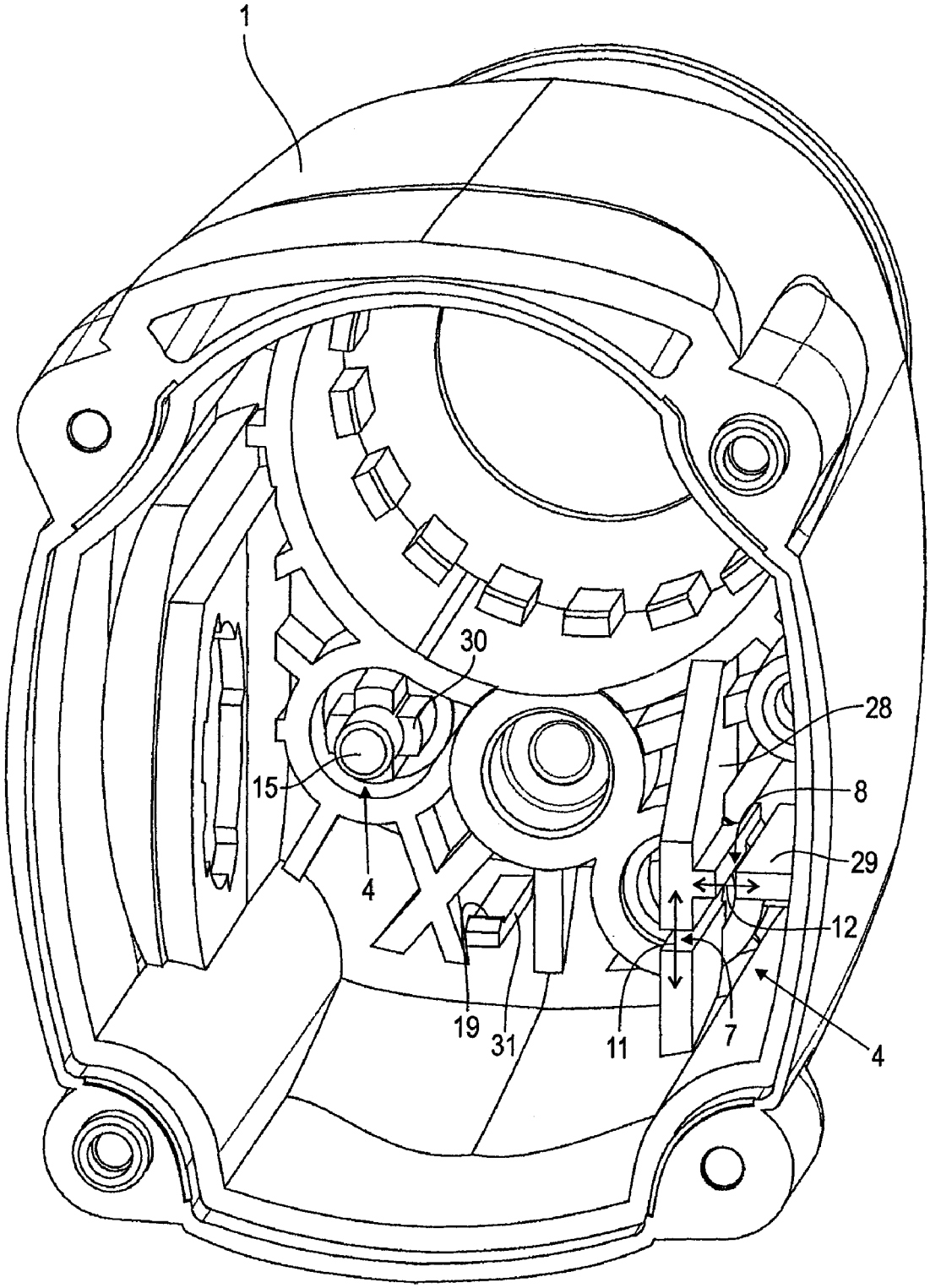
FIG. 3 is a perspective illustration of the interior of the gearbox housing according to FIGS. 1 and 2 with details of the guide means integrally formed with the gearbox housing.

FIG. 3 is an interior view of the gearbox housing 1 according to FIGS. 1 and 2 showing details of integrally formed elements of the guide means 4 on the gearbox housing. The gearbox housing 1 in the illustrated embodiment is an injection-molded plastic part but can also be a light metal die-cast part or the like. A part of the guide means 4 is the guide pin 15 that is formed integrally on the gearbox housing 1. In the foot area of the guide pin 15 radially extending noses 30 are provided that are designed for centering the spring 17 embodied as a pressure coil spring (FIGS. 1, 2, and 4). A further part of the guide means 4 are the integrally formed ribs 28, 29 on the gearbox housing 1; they each have a guide slot 7, 8. The guide slots 7, 8 form a part of the guide rail arrangement 6 provided on the gearbox housing 1 as illustrated in FIGS. 1 and 2. The ribs 28, 29 are arranged perpendicularly to one another so that the width direction of the guide rails 7 and 8 indicated by the double-arrows 11, 12 are angularly arranged and, in the illustrated embodiment, are positioned at a right angle to one another. The guide slots 7, 8 extend, like the longitudinal axis of the guide pin 15, parallel to the axis of rotation 2 of the countershaft 3 (FIG. 1, FIG. 2).

Moreover, an elastic spring tongue 31 with its locking edge 19 is formed integrally on the gearbox housing 1. The function of the spring tongue 31 with the locking edge 19 will be explained in more detail in connection with FIG. 4.

It can be expedient to employ instead of the two guide slots 7, 8 only one guide slot 7 or 8 or several guide slots.

Figure 4:
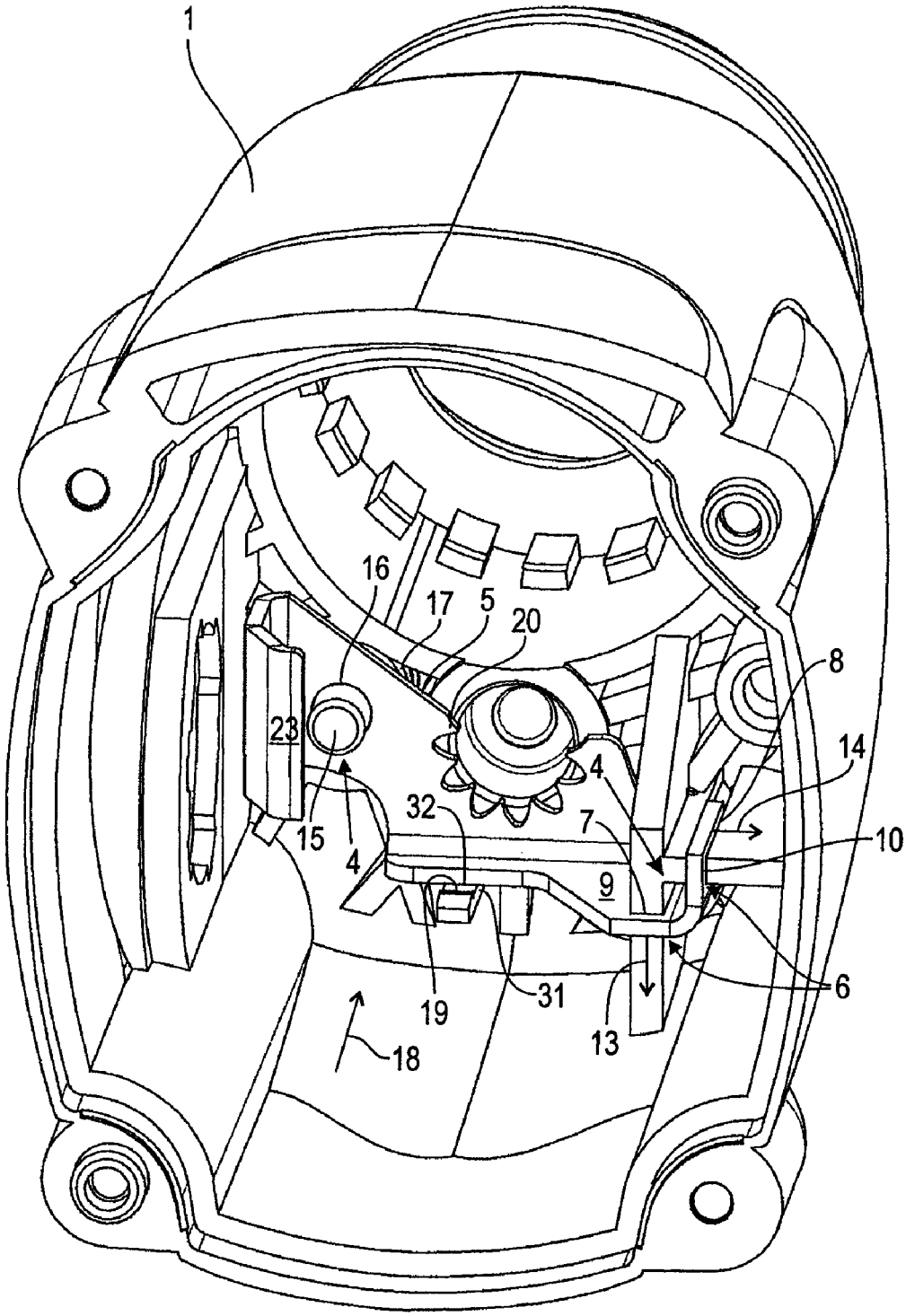
FIG. 4 shows the arrangement according to FIG. 3 with mounted locking plate that is secured by means of a spring tongue against the pretension of a pressure spring.

FIG. 4 shows the gearbox housing 1 according to FIG. 3 with mounted locking plate 5. An assembly direction is provided that is indicated by arrow 18 and extends parallel to the axis of rotation 2 and opposite to the pretension force of the spring 17 illustrated by arrow 22 (FIG. 1). The guide slots 7, 8 are open in a direction opposite to the assembly direction. The cylindrical guide pin 15 has a free end in a direction opposite to the assembly direction. On the free end there are no securing means or the like for the locking plate 5. The assembly is carried out such that first the spring 17 is pushed onto the guide pin 15 and centered by means of the noses 30 (FIG. 3). Subsequently, the locking plate 5 is inserted in the assembly direction into the guide slots 7, 8 and threaded onto the guide pin 15 in a direction opposite to the pressure force action of the spring 17.

The locking plate 5 has two legs that are angled at a right angle relative to the base member provided with teeth 20. The angled legs are positioned perpendicularly to one another as well as to the base member and form gliding surfaces 9, 10. Normals that are perpendicularly to the surface of the gliding surfaces 9, 10 are indicated by arrows 13, 14. The gliding surfaces 9, 10 are inserted into the associated guide slots 7, 8 wherein the normals on the surfaces are parallel to the width directions of the guide slots 7, 8 illustrated in FIG. 3. Accordingly, the normals on the surfaces are parallel to the surface of the associated ribs 28, 29 (FIG. 3). The gliding surfaces 9, 10 are guided in the guide slots 7, 8 parallel to the axis of rotation 2 (FIG. 1).

The guide slots 7, 8 extend opposite to the assembly direction farther than the guide pin 15 so that upon mounting of the locking plate 5 in the assembly direction first the gliding surfaces 9,10 are inserted into the guide slots 7, 8. In this way, a provisional positional alignment of the locking plate 5 relative to the gearbox housing 1 is provided. Only upon further insertion of the locking plate 5 in the assembly direction a guide opening 16 of the locking plate 5 is threaded onto the free end of the guide pin 15 wherein the pretension of the spring 17 is generated. As soon as guide pin 15 has engaged in accordance with FIG. 4 the guide opening 16, the locking plate 5 has an exact positional alignment relative to the gearbox housing. In this state the countershaft 3, illustrated in FIG. 1 and FIG. 2, is not yet mounted and therefore cannot take on a guiding function for the locking plate 5. In this connection, exclusively the guide means 4 that are integrally formed on the gearbox housing are provided for the locking plates 5. Pins that are manufactured as individual parts and mounted as individual parts or the like are not present.

When pushing the locking plate 5 onto the guide pin 15 while at the same time generating the spring pretension of the spring 17, the angled leg of the locking plate 5 that forms also the gliding surface 9 is pushed across the locking edge 19 of the elastic spring tongue 31. When the mounting position illustrated in FIG. 4 is reached, the locking edge 19 engages the edge 32 of the locking plate 5. In this way, the locking plate 5 is provisionally secured in its position against the pretension force of the spring 17 in a direction opposite to the assembly direction. In the subsequent assembly of the turn knob 27 illustrated in FIG. 1 and FIG. 2 this function of positional fixation is taken over by the actuating cylinder 24 that rests against the pressure surface 23 of the locking plate 5.

The specification incorporates by reference the entire disclosure of German priority document 10 2007 014 800.5 having a filing date of Mar. 28, 2007.

While specific embodiments of the invention have been shown and described in detail to illustrate the inventive principles, it will be understood that the invention may be embodied otherwise without departing from such principles.

What is claimed is:

1. A spindle lock of a hand-held combination drill and chisel hammer, the spindle lock comprising:

a gearbox housing;

a countershaft rotatably supported in the gearbox housing about an axis of rotation, wherein on the countershaft a pinion with a toothing is rotatably supported that drives a tool spindle;

a locking plate provided for selectively releasing and locking a rotational movement of the pinion with the toothing supported on the countershaft;

guide means disposed in the gear box housing, wherein the locking plate is displaceably guided on the guide means in the gearbox housing in a direction parallel to the axis of rotation of the countershaft;

the guide means comprising a guide rail arrangement wherein a part of the guide rail arrangement is provided on the gearbox housing and is monolithic with the gearbox housing;

wherein the guide rail arrangement has at least two guide slots extending parallel to the axis of rotation of the countershaft, wherein the locking plate has gliding surfaces and the gliding surfaces each are slidably guided in one of the at least two guide slots, wherein the at least two guide slots have a direction of width and the directions of width of the at least two guide slots are arranged angularly relative to one another.

2. The spindle lock according to claim 1, wherein the directions of width are positioned at a right angle relative to one another.

3. The spindle lock according to claim 1, wherein the at least two guide slots are integrally formed in the gearbox housing and wherein the gliding surfaces are formed by the locking plate.

4. The spindle lock according to claim 1, wherein a normal to the gliding surfaces, respectively, is parallel to the direction of width of the guide slot in which the gliding surfaces are guided, respectively.

5. The spindle lock according to claim 1, wherein the guide means comprise a guide pin formed integrally on the gearbox housing, which guide pin engages a guide opening of the locking plate.

6. The spindle lock according to claim 1, wherein, when the countershaft is demounted, only the guide means that are integrally formed on the gearbox housing are acting on the locking plate.

7. The spindle according to claim 1, further comprising a spring, wherein the locking plate is pretensioned by the spring in a direction opposite to an assembly direction of the spindle lock and wherein a locking edge is formed integrally on the gearbox housing and secures the locking plate in said direction opposite to the assembly direction.

* * * * *